US010059128B2

(12) United States Patent
Miyazaki et al.

(10) Patent No.: US 10,059,128 B2
(45) Date of Patent: Aug. 28, 2018

(54) PRINTING APPARATUS

(71) Applicant: SEIKO EPSON CORPORATION, Tokyo (JP)

(72) Inventors: Kenichi Miyazaki, Shiojiri (JP); Yoshitaka Shimada, Matsumoto (JP); Toyonori Kawafune, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/496,577

(22) Filed: Apr. 25, 2017

(65) Prior Publication Data

US 2017/0313103 A1 Nov. 2, 2017

(30) Foreign Application Priority Data

Apr. 28, 2016 (JP) ..... 2016-090392

(51) Int. Cl.
*B41J 29/17* (2006.01)
*B41J 11/58* (2006.01)

(52) U.S. Cl.
CPC ..... *B41J 11/58* (2013.01); *B41J 29/17* (2013.01)

(58) Field of Classification Search
CPC ..... B41J 29/17
See application file for complete search history.

(56) References Cited

U.S. PATENT DOCUMENTS 7,901,030 B2 * 3/2011 Miyata ..... B41J 11/007 347/103
2006/0238596 A1 * 10/2006 Mitsuhashi ..... B41J 11/007 347/104
2007/0229586 A1 * 10/2007 Hirakawa ..... B41J 2/0057 347/31
2017/0291433 A1 * 10/2017 Ueyama ..... B41J 11/02

FOREIGN PATENT DOCUMENTS

EP 1918115 * 5/2008 ..... B41J 29/17
JP 10-265075 10/1998
JP 2008114991 * 5/2008 ..... B41J 29/17
JP 2017186148 A 10/2017

* cited by examiner

*Primary Examiner* — Huan Tran
(74) *Attorney, Agent, or Firm* — Workman Nydegger

(57) ABSTRACT

A printing apparatus includes a recording head that performs printing on a printing surface of a medium, a transport portion that transports the medium in a transport direction, a medium support portion that is disposed on an upstream side in the transport direction with respect to the recording head and supports the medium, a removal portion that is disposed on the upstream side in the transport direction with respect to the recording head, and a fixing portion to which the removal portion is fixed, in which the removal portion includes a removal member that has a flexible property and comes into contact with the printing surface, and an elastic member that holds the removal member between itself and the medium support portion, and that presses the removal member.

8 Claims, 6 Drawing Sheets

PRINTING APPARATUS

BACKGROUND

1. Technical Field

The present invention relates to a printing apparatus.

2. Related Art

An ink jet type printer, which is an example of a printing apparatus, is provided with a transport portion that transports a medium, and a recording head, which includes a nozzle formation surface that discharges an ink, and prints a desired image on the medium by alternately repeating an operation that discharges the ink from the nozzle formation surface while moving the recording head in a direction that intersects a transport direction, and an operation that transports the medium in the transport direction. In addition, in a section that prints an image, since the nozzle formation surface is disposed in proximity to the medium in order to cause discharged ink to land accurately in a predetermined position, it is likely that the nozzle formation surface will be subjected to the adverse effects of foreign matter that is adhered to the medium.

A printing apparatus is used in an environment in which foreign matter such as dust, fluff, or the like, is present. Therefore, it is likely that the foreign matter due to environmental factors will become adhered to the medium and be taken inside the printing apparatus. If foreign matter is taken into a section that prints an image, there is a concern that the foreign matter will become adhered to the nozzle formation surface, that the ink discharge performance of the recording head will change, and therefore, that there will be a decrease in the printing quality of an image.

For example, the printer (printing apparatus) disclosed in JP-A-10-265075 includes a dust removal member for removing dust, and is configured so that the adverse effects of foreign matter are suppressed by removing dust (foreign matter) adhered to a roller using the dust removal member. To explain in more detail, the dust removal member is a brush, and the foreign matter is removed by scraping away foreign matter adhered to the roller using the brush.

However, in the printing apparatus disclosed in JP-A-10-265075, there is a concern that foreign matter scraped away by the brush will be scattered at the periphery, become adhered to the medium, or the like, and cause staining of the nozzle formation surface. Furthermore, since a configuration that removes the foreign matter adhered to the medium due to environmental factors is not included, there is a concern that foreign matter adhered to the medium due to environmental factors will become adhered to the nozzle formation surface, that the ink discharge performance of the recording head will change, and therefore, that there will be a decrease in the printing quality of an image.

SUMMARY

The invention can be realized as the following aspects or application examples.

Application Example 1

According to this application example, there is provided a printing apparatus including a printing portion that performs printing on a printing surface of a medium, a transport portion that transports the medium in a transport direction, a medium support portion that is disposed on an upstream side in the transport direction with respect to the printing portion and supports the medium, a removal portion that is disposed on the upstream side in the transport direction with respect to the printing portion, and a fixing portion to which the removal portion is fixed, in which the removal portion includes a removal member that has a flexible property and comes into contact with the printing surface, and an elastic member that holds the removal member between itself and the medium support portion, and that presses the removal member.

There is a concern that foreign matter due to environmental factors (for example, airborne dust and fluff) and foreign matter due to non-environmental factors (for example, foreign matter arising during handling of the medium, foreign matter of a process for manufacturing the medium, or the like) will become adhered to the printing surface of the medium, will be taken into the printing portion, and that there will be adverse effects on the printing portion as a result.

Since the removal member is provided so as to come into contact with the printing surface of the medium on the upstream side in the transport direction with respect to the printing portion, foreign matter adhered to the printing surface of the medium is removed by the removal member, and therefore, it is unlikely that the foreign matter will be taken into the printing portion. Furthermore, since, in the removal member, a portion that comes into contact with the printing surface of the medium is pressed by the elastic member, in comparison with a case of not being pressed by the elastic member, a force with which foreign matter, which is biased from the removal member, is removed is strong, and therefore, the foreign matter removal performance of the removal member is enhanced and it is more unlikely that the foreign matter will be taken into the printing portion.

Accordingly, it is possible to suppress the concern that there will be adverse effects on the printing portion as a result of foreign matter of environmental factors and foreign matter of non-environmental factors being taken into the printing portion.

Application Example 2

In the printing apparatus according to the application example, it is preferable that the removal member be slack between a section fixed to the fixing portion, and a section pressed by the elastic member.

It is unlikely that the removal member will move in the section that is fixed by the fixing portion, and the section pressed by the elastic member, and therefore, attains a substantially fixed state. When the removal member is slack between the section that is fixed by the fixing portion, and the section pressed by the elastic member, a section of the removal member that is slack is deformed in a tare weight direction (a direction of coming into contact with the printing surface of the medium) by the tare weight thereof, and a contact surface at which the removal member comes into contact with the printing surface of the medium (hereinafter, simply referred to as a contact surface) is formed.

Since the contact surface is disposed between the section that is fixed by the fixing portion and the section pressed by the elastic member, it is unlikely that a change in the shape of the contact surface will occur, fluctuation of the surface area of the contact surface is suppressed, and therefore, it is possible for the removal member to stably remove foreign matter adhered to the printing surface of the medium.

Application Example 3

In the printing apparatus according to the application example, it is preferable that the removal member and the elastic member be disposed so that, among portions of the removal member, a facing portion with the medium protrudes more than a facing portion with the medium among portions of the elastic member.

When, among portions of the removal member, a facing portion with the medium protrudes further than a facing portion with the medium among portions of the elastic member, it is unlikely that the elastic member will come into contact with the printing surface of the medium in a case in which the removal member comes into contact with the medium. As a result of this, the adverse effect of the elastic member coming into contact with the printing surface of the medium, and for example, mechanical damage to the printing surface of the medium, transport faults of the medium, and the like, are suppressed.

Application Example 4

In the printing apparatus according to the application example, it is preferable that, in the removal member, one end portion and another end portion be fixed to the fixing portion, and that a section which is curved between the one end portion and the other end portion comes into contact with the printing surface.

For example, if a portion of an end portion of the contact surface is not fixed and can be displaced, it is likely that the surface area of the contact surface will fluctuate. If an end portion of the contact surface is fixed, it is unlikely that the surface area of the contact surface will fluctuate.

The configuration in which the section which is curved between the one end portion and the other end portion comes into contact with the printing surface is a configuration in which the contact surface is formed between the one end portion and the other end portion, and is equivalent to a configuration in which the end portions of the contact surface are fixed, fluctuation of the surface area of the contact surface is suppressed, and therefore, it is possible for the removal member to stably remove foreign matter adhered to the printing surface of the medium.

Application Example 5

In the printing apparatus according to the application example, it is preferable that a length of the elastic member in a width direction, which is orthogonal to the transport direction, be shorter than a length of the removal member in the width direction, and that, among portions of the elastic member, an end portion in the width direction be disposed on an inner side of an end portion in the width direction among portions of the removal member.

Since, among portions of the elastic member, the end portion in the width direction is disposed on the inner side of the end portion in the width direction among portions of the removal member, it is unlikely that the elastic member will come into contact with the printing surface of the medium in a case in which the removal member comes into contact with the medium. As a result of this, the adverse effect of the elastic member coming into contact with the printing surface of the medium, for example, mechanical damage to the printing surface of the medium, transport faults of the medium, and the like, are suppressed.

Application Example 6

In the printing apparatus according to the application example, it is preferable that the removal portion be disposed so as to, among portions of the medium, come into contact with an end portion in the width direction, which is orthogonal to the transport direction.

For example, when rolled paper or cut paper is used as the medium, among portions of the medium, it is likely that a large amount of foreign matter will become adhered to the end portion in the width direction (for example, cutting waste becomes adhered to the end portions in the width direction as a result of a cutting process) as a result of a manufacturing process of the medium (for example, a cutting process that cuts the medium). Since the removal portion is disposed so as to come into contact with the end portion in the width direction among portions of the medium, it is possible to suppress a defect in which a large amount of foreign matter attached to the end of the printing surface of the medium is not removed as a result of the removal portion not coming into contact with the end portion in the width direction among portions of the medium.

Application Example 7

In the printing apparatus according to the application example, it is preferable that the removal portion be divided into a plurality along a direction that intersects the transport direction.

In a case in which the removal portion is deteriorated due to staining, scuffing, and the like, since it is sufficient to replace deteriorated removal portions only among the removal portion that is divided into a plurality, it is possible to suppress maintenance costs of the removal portion in comparison with a case in which the entire removal portion is replaced. Furthermore, since the removal portions are smaller when the removal portion is divided into a plurality, replacement work of the removal portion is easier in comparison with a case in which the removal portion is large.

Application Example 8

In the printing apparatus according to the application example, it is preferable that the removal member be an aggregate of fibers.

When the removal member is configured by an aggregate of fibers, it is possible to provide uneven portions on the contact surface of the removal member. When the contact surface has uneven portions, it is more likely that the foreign matter will be removed in comparison with a case in which the contact surface is smooth, and therefore, it is possible to enhance the foreign matter removal performance of the removal member.

Furthermore, when the removal member is configured by an aggregate of a fiber, a space is formed in the inner portion of the removal member, and therefore, it is possible to trap (hold) foreign matter in the corresponding space. Accordingly, when a space is formed in the inner portion of the removal member, it is possible to enhance the foreign matter trapping performance of the removal member in comparison with a case in which a space is not formed in the inner portion of the removal member.

Application Example 9

In the printing apparatus according to the application example, it is preferable that the removal portion be attached to the fixing portion in a detachable manner.

Since the removal portion is attached to the fixing portion in a detachable manner, in a case in which the foreign matter removal performance of the removal portion is decreased, it is possible to reuse the removal portion in which the foreign matter removal performance is decreased by detaching the removal portion and fixing the removal portion to the fixing portion after implementing maintenance, which restores the foreign matter removal performance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
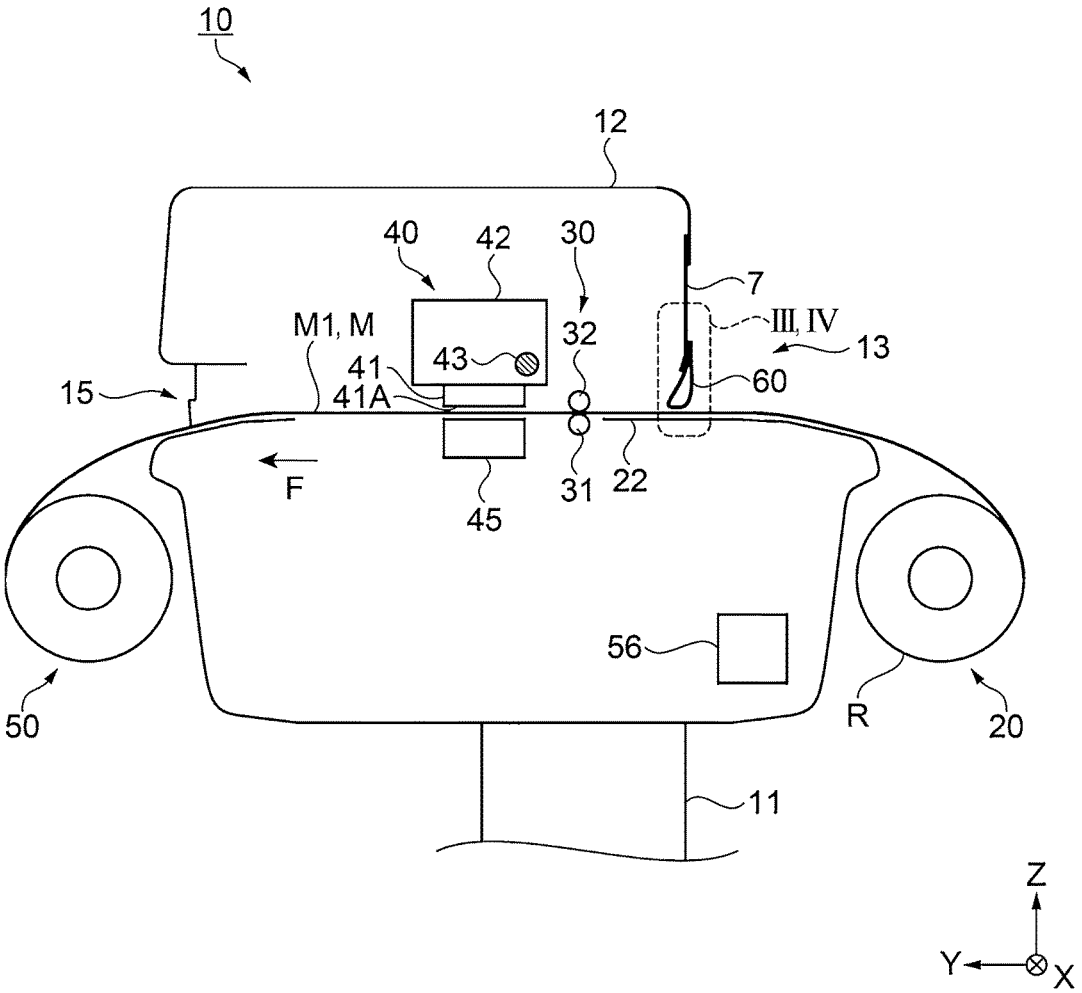
FIG. 1 is a schematic cross-sectional view that shows a configuration of a printing apparatus according to Embodiment 1.

Hereinafter, embodiments of the invention will be described with reference to the drawings. The embodiments illustrate aspects of the invention, but do not limit the invention, and can be changed arbitrarily within a range of the technical idea of the invention. In addition, in each of the drawings below, the scales are altered for each layer and each location in order to make each layer and each location have a size that is easy to understand in the drawings.

Embodiment 1

Summary of Printing Apparatus

FIG. 1 is a schematic cross-sectional view that shows a configuration of a printing apparatus according to Embodiment 1.

Firstly, a summary of a printing apparatus 10 will be described with reference to FIG. 1.

As shown in FIG. 1, the printing apparatus 10 is a large format printer (LFP) that handles a longitudinal medium M. The printing apparatus 10 is provided with a leg portion 11, a housing portion 12 that is supported by the leg portion 11, and a setting portion 20 and a wind-up portion 50 that are attached to both ends of the housing portion 12. For example, it is possible to use a wood free paper, a cast paper, an art paper, a coated paper, a synthetic paper, a film composed of polyethylene terephthalate (PET), polypropylene (PP), or the like, or similar as the medium M.

In the description from this point onwards, the height direction of the printing apparatus 10 will be set as a Z direction, a direction, which is orthogonal to the Z direction, of running toward the wind-up portion 50 from the setting portion 20 will be set as a Y direction, and a direction (a width direction of the medium M) that is orthogonal to the Z direction and the Y direction will be set as an X direction. In addition, tip end sides of the arrows that show the directions are set as (+) directions, and base end sides thereof are set as (−) directions.

Additionally, the X direction is an example of "a width direction that is orthogonal to the transport direction".

A transport portion 30 that transports the medium M in a transport direction F, a printing region 40, a control portion 56 that controls each portion of the printing apparatus 10, a medium support portion 22, and a removal portion 60 are provided in the inner portion of the housing portion 12. Furthermore, a recording head 41, which is an example of a "printing portion", is disposed in the printing region 40.

In addition, the setting portion 20 and the wind-up portion 50 are disposed in lower positions than the recording head 41.

The medium M is unwound from a roll body R that is accommodated in the setting portion 20, is fed to the inner portion of the housing portion 12 from a feeding port 13, is ejected to the outer portion of the housing portion 12 from an ejection port 15 after printing is perform thereon in the printing region 40, and is wound up in roll form by the wind-up portion 50.

Additionally, the medium M need not necessarily be rolled paper and may be single sheet paper.

The transport portion 30 transports the medium M in the transport direction F. More specifically, the transport portion 30 transports the medium M, which is fed from the setting portion 20, toward the printing region 40 (the recording head 41). The transport portion 30 is disposed on the upstream side in the transport direction F with respect to the printing region 40 (the recording head 41), and includes a driving roller 31 and a driven roller 32. The driven roller 32 is driven to rotate as a result of being brought into a pressing contact with the driving roller 31 via the medium M. The driving roller 31 holds the medium M between itself and the driven roller 32. The medium M is transported in the transport direction F as a result of the driving roller 31 being driven in a rotational manner by a driving motor (not illustrated in the drawings).

The recording head 41, a carriage 42 that holds the recording head 41, a platen 45 that supports the medium M, and a guide shaft 43 that supports the carriage 42 are did in the printing region 40.

The recording head 41 prints images on a printing surface M1 of the medium M by discharging an ink. In other words, the recording head 41 functions as a printing portion that performs printing on the printing surface M1 of the medium M. Additionally, it is sufficient as long as the printing portion performs printing of images on the medium M, and may have a configuration such as a transfer roller that transfers images to the medium M. When foreign matter becomes adhered to a transfer roller, foreign matter is transferred to the medium M together with the images, and there is a concern that there will be a decrease in the printing quality of the images.

The recording head 41 includes a nozzle formation surface 41A, in which a plurality of nozzles (not illustrated in the drawings), and discharges the ink onto the printing surface M1 of the medium M. The carriage 42, which holds the recording head 41, reciprocates in a width direction (the X direction) of the medium M as a result of the motive power of the driving motor (not illustrated in the drawings). The platen 45 is provided with a substantially rectangular surface, in which the width direction of the medium M is set as a longitudinal direction, on the upper surface thereof, which faces the recording head 41. A surface that is on a side that is opposite to the printing surface M1 of the medium M is supported using suction on the upper surface of the platen 45 as a result of a negative pressure that is applied to the platen 45. As a result of this, a decrease in printing quality due to lifting of the medium M is prevented.

In the printing apparatus 10, predetermined images are formed (printed) by aligning rows of a plurality of dots (raster lines) on the printing surface M1 of the medium M as a result of alternately repeating an operation that discharges the ink onto the printing surface M1 of the medium M from the recording head 41 while causing the carriage 42 to reciprocate in the X direction, and an operation in which the transport portion 30 transports the medium M in the transport direction F (the Y direction).

Additionally, in the present embodiment, a serial head type recording head, which is mounted in the reciprocating carriage 42, and discharges the ink while moving in the width direction (the X direction) of the medium M, is illustrated as the recording head 41 by way of example, but a line head type recording head that is fixedly arranged extending in the width direction (the X direction) of the medium M may also be used.

The medium support portion 22 is disposed on the upstream side in the transport direction F with respect to the printing region 40 (the recording head 41), and guides the medium M, which is fed from the setting portion 20, to the transport portion 30 by supporting the medium M.

The housing portion 12 includes a section (a section that extends in the Z (−) direction) that is folded over in the inner portion thereof close to the feeding port 13. A fixing portion 7, which is a section to which the removal portion 60 is fixed, is attached to the folded over section of the housing portion 12. The fixing portion 7 is configured by a magnetic material (for example, a stainless steel having a magnetic property). Further, the removal portion 60 is attached (fixed) to the fixing portion 7. The removal portion 60 is disposed on the upstream side in the transport direction F with respect to the printing region 40 (the recording head 41) and comes into contact with the printing surface M1 of the medium M.

Additionally, the details of the removal portion 60 will be described later.

There are cases in which foreign matter becomes adhered to the printing surface M1 of the medium M due to various factors. For example, foreign matter of environmental factors such as airborne fluff or dust may become adhered to the printing surface M1 of the medium M. In addition, foreign matter of non-environmental factors such as fluff or dust may become adhered to the printing surface M1 of the medium M as a result of a process of manufacturing the roll body R (for example, a cutting process in which cutting is performed) or a handling operation of loading the roll body R onto the setting portion 20.

Further, there is a concern that foreign matter, which has become adhered to the printing surface M1 of the medium M, will be taken into the printing region 40, and become adhered to the nozzle formation surface 41A of the recording head 41.

If a portion of the nozzles are obstructed as a result of foreign matter becoming adhered to the nozzle formation surface 41A of the recording head 41, defects such as the ink not being discharged uniformly from the plurality of nozzles provided in the nozzle formation surface 41A can occur. For example, defects such as printing irregularities may occur as a result of the contrast differing between a raster line formed by nozzles obstructed by foreign matter and a raster line formed by nozzles that are not obstructed by foreign matter.

In the present embodiment, in a case in which the medium M is supplied to the transport portion 30 from the setting portion 20, the removal portion 60 removes foreign matter adhered to the printing surface M1 of the medium M as a result of coming into contact with the printing surface M1 of the medium M. Accordingly, it is unlikely that foreign matter adhered to the printing surface M1 of the medium M will be taken into the printing region 40, and therefore, it is unlikely that a defect caused by the above-mentioned foreign matter of environmental factors or foreign matter of non-environmental factors will occur.

Summary of Removal Portion

Figure 2:
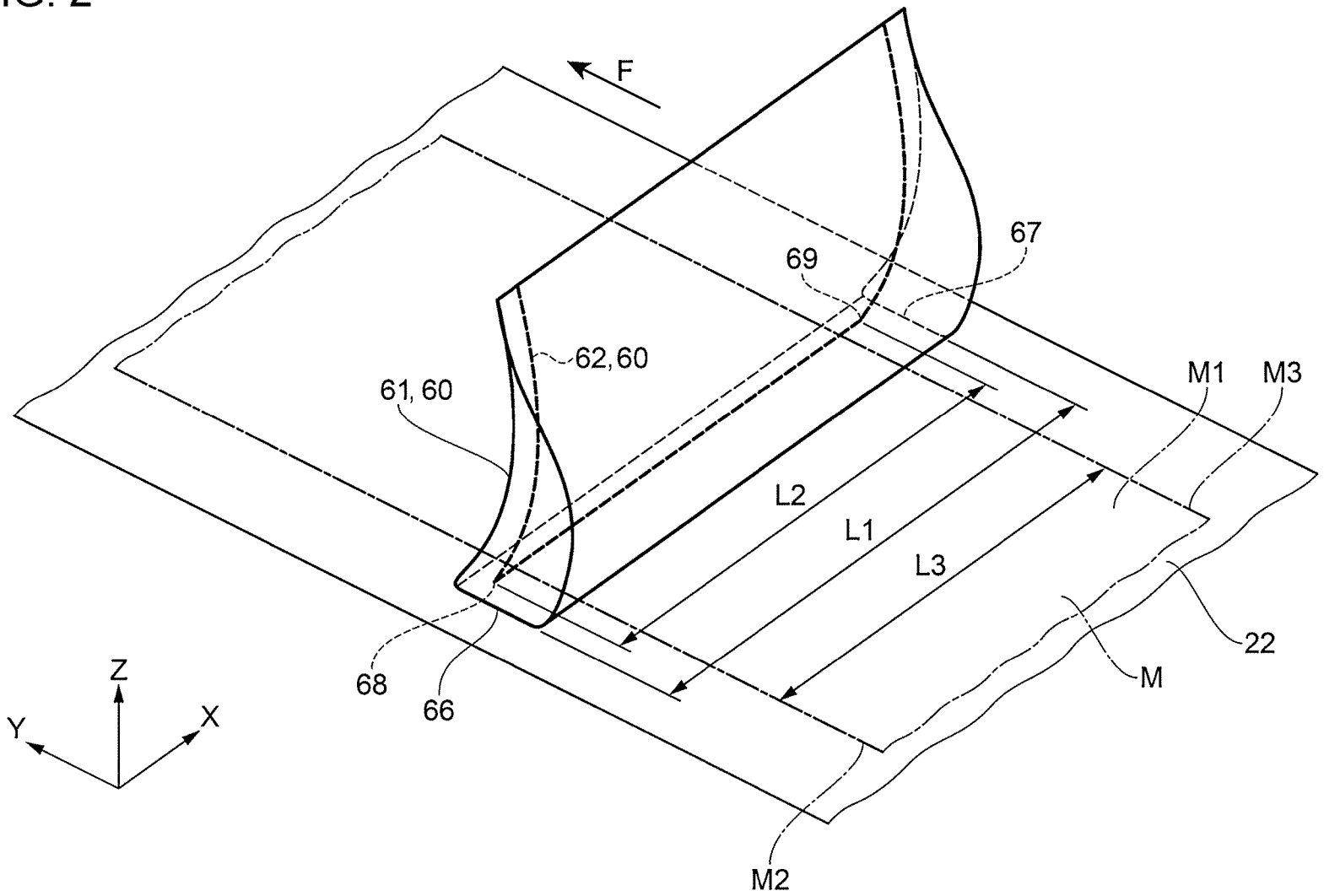
FIG. 2 is a schematic view that shows a state of a removal portion viewed in an oblique direction.
Figure 3:
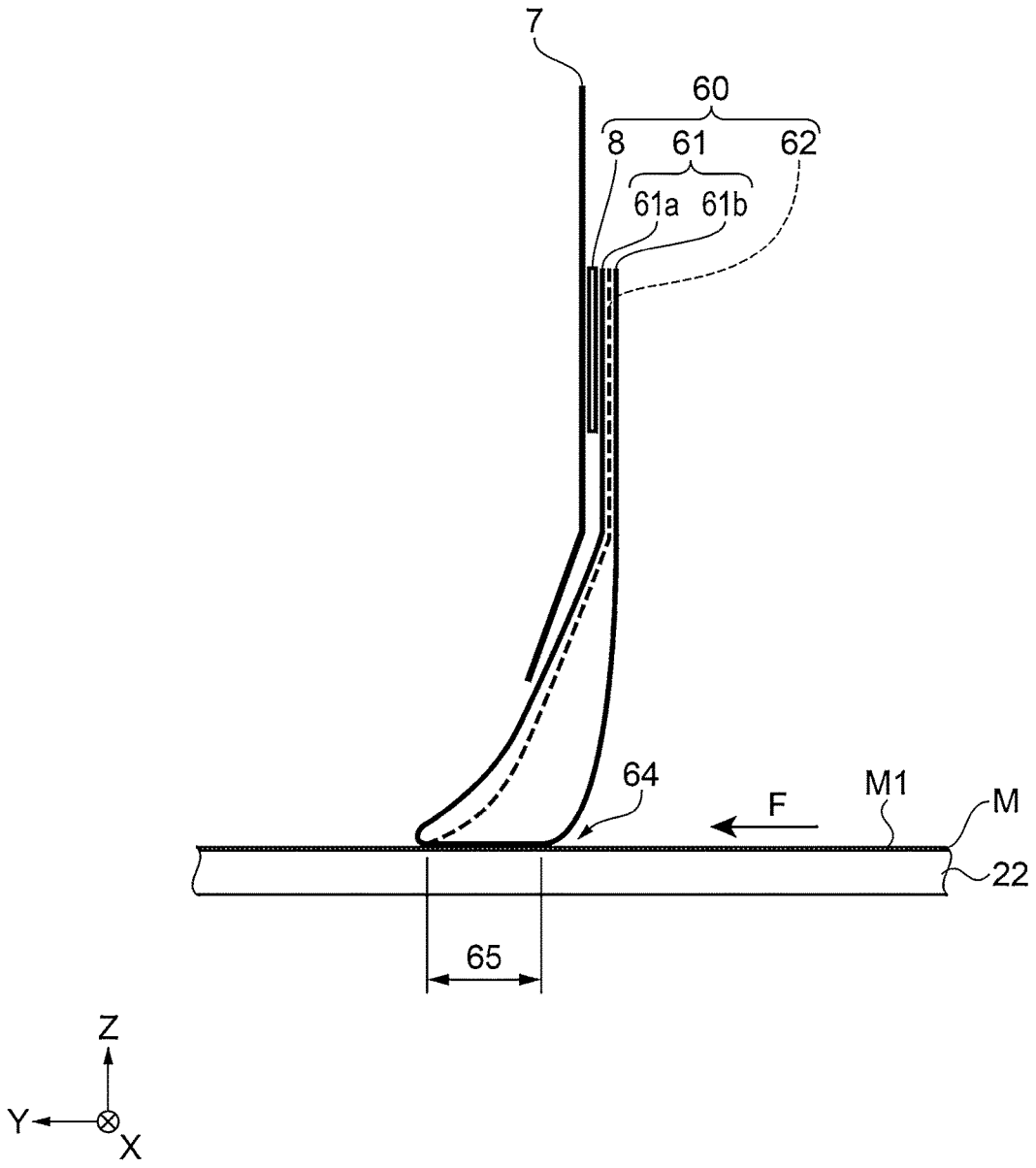
FIG. 3 is an enlarged view of a region III that is surrounded by a broken line in FIG. 1.
Figure 4:
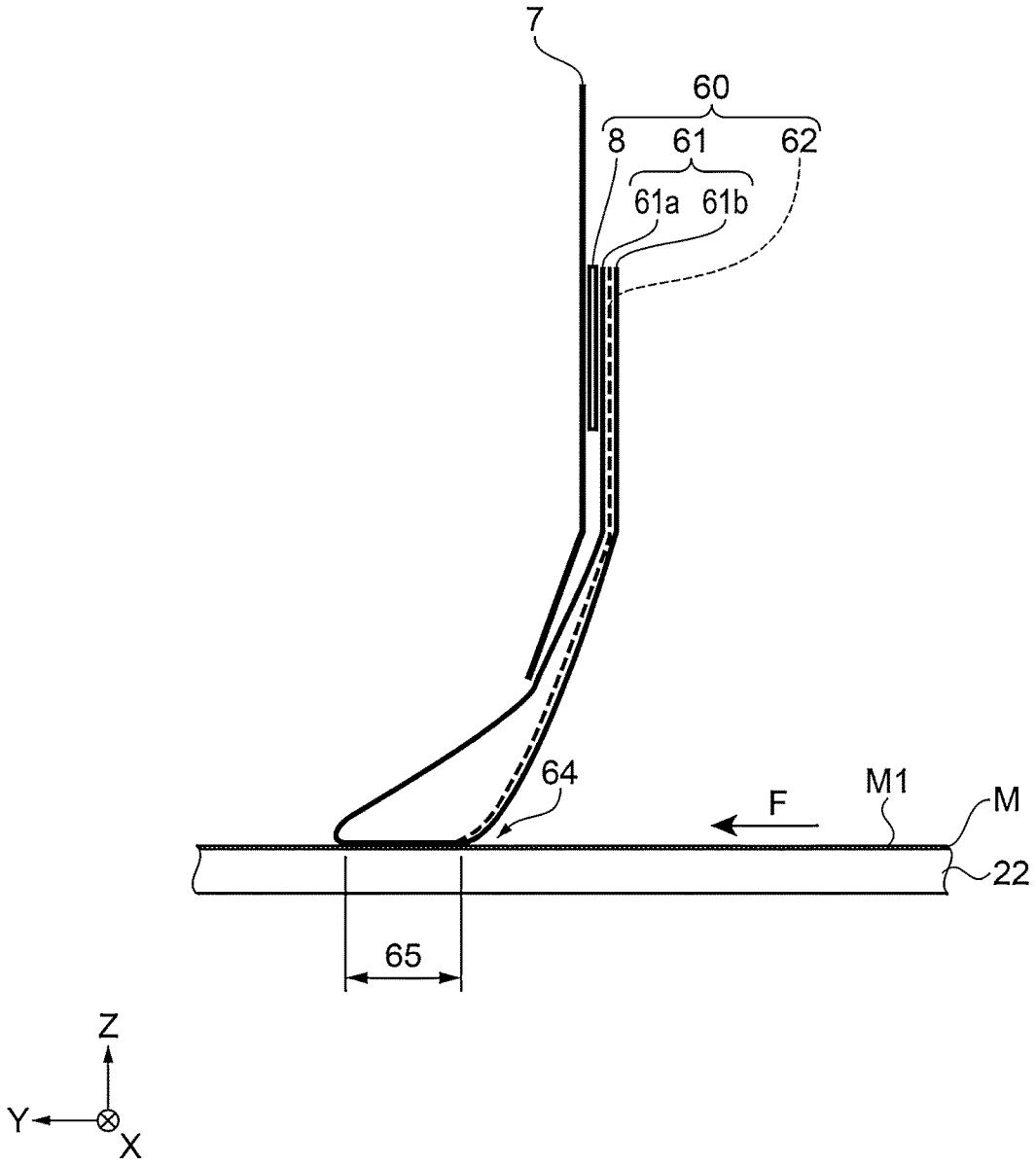
FIG. 4 is an enlarged view of the region IV that is surrounded by a broken line in FIG. 1.

FIG. 2 is a schematic view that shows a state of a removal portion viewed in an oblique direction (a direction that intersects the printing surface of a medium). FIGS. 3 and 4 are enlarged views of a region III and a region IV that is surrounded by a broken line in FIG. 1, and are schematic views that show states of the removal portion.

In FIGS. 2 to 4, the illustration of constituent elements that are unnecessary for the description is omitted, and the elastic member 62 is illustrated by using a broken line in order to facilitate understanding of the states of the removal portion 60. In addition, in FIG. 2, the medium M is illustrated by using a dashed-dotted line. In addition, the state of a removal member 61 in FIG. 2 corresponds to the state of the removal member 61 in FIG. 3.

Next, a summary of the removal portion 60 will be described with reference to FIGS. 2 to 4.

As shown in FIG. 2, the removal portion 60 has a shape that is long in a direction (the X direction) orthogonal to the transport direction F, and is configured by the removal member 61, the elastic member 62 and a magnet (refer to FIG. 3).

A length L2 in the X direction (the width direction) of the elastic member 62 is shorter than a length L1 in the X direction (the width direction) of the removal member 61, and end portions 68 and 69 of the elastic member 62 in the width direction are disposed on the inner sides of end portions 66 and 67 in the width direction of the removal member 61. Therefore, the elastic member 62 does not come into direct contact with the printing surface M1 of the medium M. Although described in more detail later, since the elastic member 62 is configured by hard material having higher rigidity than that of the removal member 61, if the elastic member 62 comes into contact with the printing surface M1 of the medium M, it is likely that mechanical damage of the printing surface M1 of the medium M will occur, and therefore, it is likely that an excessive force will be applied from the elastic member 62 a transport fault of the medium M will occur. Since the elastic member 62 does not come into direct contact with the printing surface M1 of the medium M, it is possible to suppress a defect (mechanical damage or a transport fault) caused by the elastic member 62 coming into contact with the printing surface M1 of the medium M.

The length L1 of the removal member 61 in the X direction (the width direction) is longer than a length L3 of the medium M in the X direction (the width direction), and the end portions 66 and 67 of the removal member 61 in the width direction are disposed on the outer sides of ends M2 and M3 of the printing surface M1 of the medium M. That is, the removal member 61 (the removal portion 60) is disposed so as to come into contact with the ends M2 and M3 of the printing surface M1 of the medium M.

As a result of using a process (for example, a cutting process in which cutting is performed) that manufactures the roll body R, it is likely that a large amount of foreign matter will become adhered to the end portions of the medium M in the X direction (the width direction), that is, the ends M2 and M3 of the printing surface M1 of the medium M (for example, cutting waste becomes adhered to the end portions of the medium M in the width direction as a result of using a cutting process). Since the removal member 61 (the removal portion 60) is disposed so as to come into contact with the ends M2 and M3 of the printing surface M1 of the medium M, it is possible to suppress a defect in which the removal member 61 (the removal portion 60) does not come into contact with the ends M2 and M3 of the printing surface M1 of the medium M and a large amount of foreign matter adhered to the end of the printing surface M1 of the medium M is not removed.

As shown in FIG. 3, the removal portion 60 includes the magnet 8 in a section fixed to the fixing portion 7, and is attached to the fixing portion 7 in a detachable manner as a result of using a magnetic force of the magnet 8.

Additionally, for example, the removal portion 60 may also have a configuration that is attached to the fixing portion 7 in a detachable manner as a result of using a screw.

The magnet 8, the removal member 61, and the elastic member 62 are bonded to one another by using an adhesive sheet (not illustrated in the drawings), for example, in a section in which the removal portion 60 is fixed to the fixing portion 7. In addition, the removal member 61 and the elastic member 62 are not bonded to one another in a region in which the magnet 8 is not disposed, and therefore, it is possible for the removal member 61 and the elastic member 62 to respectively be displaced in a free manner.

If the removal member 61 and the elastic member 62 are bonded to one another in the region in which the magnet 8 is not disposed and the degree of freedom of displacement of the removal member 61 is blocked, there is a concern that the removal member 61 will be displaced as a result of being subjected to the influence of the elastic member 62, and that it will be unlikely that the removal member 61 come into contact with the printing surface M1 of the medium M. If the uniformity of the contact area of the removal member 61 and the printing surface M1 of the medium M deteriorates, it is unlikely that the removal member 61 will uniformly remove foreign matter adhered to the printing surface M1 of the medium M.

End portions 61*a* and 61*b* of the removal member 61 are disposed so that the elastic member 62 is interposed therebetween. In the removal member 61, the end portion 61*a* and the end portion 61*b* are fixed to the fixing portion 7. The removal member 61 between the end portion 61*a* and the end portion 61*b* is displaced in the Z (−) direction (the gravity direction) due to the tare weight thereof, and comes into contact with the printing surface M1 of the medium M. That is, the removal member 61 comes into contact with the printing surface M1 of the medium M at a section 64 that is curved between the end portion 61*a* and the end portion 61*b*. In other words, the removal member 61 has a loop shape, both ends (the end portions 61*a* and 61*b*) of which are substantially closed, and the section 64, which is curved between the end portion 61*a* and the end portion 61*b*, comes into contact with the printing surface M1 of the medium M.

Additionally, the end portion 61*a* is an example of "one end portion", and the end portion 61*b* is an example of "another end portion".

In this manner, among surfaces of the removal member 61, a contact surface 65, which comes into contact with the printing surface M1 of the medium M, is formed by using the section 64, which is curved between the end portion 61*a* and the end portion 61*b*, which are fixed to the fixing portion 7. In other words, both the end portions 61*a* and 61*b* of the removal member 61, which forms the contact surface 65, are fixed to the fixing portion 7.

For example, in a case in which one (for example, the end portion 61*a*) of the end portions 61*a* and 61*b* of the removal member 61, which forms the contact surface 65, is not fixed to the fixing portion 7, it is likely that the removal member 61 will become displaced on the end portion 61*a* side. If the removal member 61 is displaced on the end portion 61*a* side, the area of the contact surface 65 fluctuates, and therefore, the foreign matter removal performance of the removal member 61 fluctuates.

In the present embodiment, since both the end portions 61*a* and 61*b* of the removal member 61, which forms the contact surface 65, are fixed to the fixing portion 7, it is less likely that the area of the contact surface 65 of the removal member 61 will fluctuate than in a case in which one end of the end portions 61*a* and 61*b* of the removal member 61 is not fixed, and therefore, it is possible for the removal member 61 to stably remove foreign matter adhered to the printing surface M1 of the medium M.

Additionally, the end portion 61*a* and the end portion 61*b* are disposed in proximity to one another with the elastic member 62 interposed therebetween, but the end portion 61*a* and the end portion 61*b* may also have a configuration of being disposed spatially separated from one another.

The removal member 61 is a non-woven fabric formed by partially bonding fibers, and has a flexible property. That is, the removal member 61 is an aggregate of fibers. The fibers that configure the removal member 61 can use a synthetic fiber such as polyester fiber, a polyamide fiber, or a polyolefin fiber, a semi-synthetic fiber such as an acetate, a regenerated fiber such as a cupra or a rayon, or a natural fiber such as cotton.

Additionally, the removal member 61 may be a felt configured in a cloth form by entwining fibers. The removal member 61 may be a cloth formed by weaving or knitting fibers.

Since the removal member 61 is an aggregate of a multitude of fibers, the outer surface (the contact surface 65) of the removal member 61 has a multitude of uneven portions. If the contact surface 65 of the removal member 61 has a multitude of uneven portions, it is more likely that the foreign matter adhered to the printing surface M1 of the medium M will be removed in comparison with a case in which the contact surface 65 of the removal member 61 is smooth, and therefore, it is possible to enhance the foreign matter removal performance of the removal member 61.

As a result of being an aggregate of a multitude of fibers, the removal member 61 has a multitude of spaces (hollow cavities) in the inner portion thereof. If there are spaces in the inner portion of the removal member 61, foreign matter removed by the removal member 61 is trap (held) in the spaces, and therefore, it is possible to suppress scattering of the foreign matter. That is, when the removal member 61 includes spaces in the inner portion thereof, it is possible to trap (hold) more foreign matter in the inner portion of the removal member 61 than in a case in which the removal member 61 does not include spaces in the inner portion thereof, and therefore, it is possible to enhance the foreign matter trapping performance of the removal member 61.

For example, if the removal member 61 is configured by a brush, in comparison with a case in which the removal member 61 is configured by an aggregate of fibers, the spaces of the inner portion of the brush become too wide, and therefore, it is unlikely that foreign matter will be accommodated (held) in the inner portion of the brush. Therefore, it is likely that foreign matter removed by the brush will pass through the inner portion of the brush and become adhered to the printing surface M1 of the medium M again.

For example, in a case in which the removal member 61 is configured as a rubber plate, since a rubber plate does not include spaces, which accommodate (hold) foreign matter in the inner portion thereof, there is a concern that foreign matter adhered to the printing surface M1 of the medium M will be scattered (spread).

Accordingly, it is preferable that the removal member 61 be an aggregate of a multitude of fibers.

Additionally, in order to prevent the foreign matter removal performance and the foreign matter trapping performance of the removal member 61 from deteriorating, it is preferable that foreign matter trapped by the removal member 61 be takes away at regular intervals by using a cleaning member (for example, a brush).

In the present embodiment, since the removal portion 60 is attached to the fixing portion 7 in a detachable manner, in a case in which the foreign matter removal performance of the removal portion 60 is decreased, the removal portion 60 is detached from the fixing portion 7, and the removal portion 60 is fixed to the fixing portion 7 after implementing maintenance (work that takes away foreign matter trapped by the removal portion 60) that restores the foreign matter removal performance. Since a removal portion 60 with decreased foreign matter removal performance is reused as a result of regeneration thereof, it is possible to suppress upkeep costs (maintenance costs) of the printing apparatus 10.

For example, the elastic member 62 is configured by an elastomer, a resin foam, a urethane rubber, a silicone rubber, a nitrile rubber, a chloroprene rubber, or the like. That is, the elastic member 62 is configured by a hard material having higher rigidity than that of the removal member 61, and has an elastic property.

The elastic member 62 is a plate form member that extends toward the medium support portion 22 from the fixing portion 7, and is disposed on the inner side of the loop-shaped removal member 61. Further, the removal member 61 and the elastic member 62 are disposed so that, among portions of the removal member 61, a facing portion with (an end portion on the Z (−) direction side) the medium M protrudes on the Z (−) direction side more than a facing portion (an end portion on the Z (−) direction side) with the medium M among portions of the elastic member 62. In this instance, the term "facing portion with the medium M" refers to sections of the respective members that face the medium M. In other words, the term "facing portion with the medium M" refers to sections of the respective members that either come into contact with or are in proximity to the medium M.

When, among portions of the removal member 61, the facing portion with the medium M protrudes further than the facing portion with the medium M among portions of the elastic member 62, it is unlikely that the elastic member 62 will come into contact with the printing surface M1 of the medium M in a case in which the removal member 61 comes into contact with the printing surface M1 of the medium M. As a result of this, the adverse effect of the elastic member 62 coming into contact with the printing surface M1 of the medium M, and for example, mechanical damage to the printing surface M1 of the medium M, transport faults of the medium M, and the like, are suppressed.

In a case in which the medium M is not transported, the elastic member 62 is disposed so as to hold the removal member 61 between itself and the medium support portion 22. That is, the removal member 61 is held between the medium support portion 22 and the elastic member 62. The elastic member 62 curves in a section (a section that comes into contact with the removal member 61) that holds the removal member 61 therebetween, and presses the removal member 61. In addition, displacement (changes in position) of the removal member 61 is blocked in the section in which the elastic member 62 presses the removal member 61. That is, among sections of the removal member 61, the section fixed to the fixing portion 7 and the section pressed by the elastic member 62 are in substantially fixed states as a result of displacement (changes in position) being blocked.

Furthermore, among sections of the removal member 61, the area between the section fixed to the fixing portion 7 and the section pressed by the elastic member 62 is slack and can be displaced. Therefore, among sections of the removal member 61 the area between the section fixed to the fixing portion 7 and the section pressed by the elastic member 62 is displaced in a direction in which the medium support portion 22 (the medium M) is disposed.

When the medium M is transported in the transport direction F, the elastic member 62 is displaced in the transport direction F while pressing the removal member 61. In other words, among sections of the elastic member 62, the position of the section that presses the removal member 61 moves in the transport direction F. When this occurs, the length of the slack section of the removal member 61 (also referred to as an amount of slack of the removal member 61) between the section fixed to the fixing portion 7 and the section pressed by the elastic member 62 increases on either the upstream side in the transport direction F with respect to the elastic member 62 or the downstream side in the transport direction F with respect to the elastic member 62. That is, asymmetry in the amount of slack of the removal member 61 occurs between the upstream side in the transport direction F with respect to the elastic member 62 and the downstream side in the transport direction F with respect to the elastic member 62.

For example, as shown in FIG. 3, there is a large amount of slack of the removal member 61 on the upstream side in the transport direction F with respect to the elastic member 62 and there is a small amount of slack on the downstream side in the transport direction F with respect to the elastic member 62. When this occurs, as a result of the tare weight thereof, the removal member 61 is displaced in the direction in which the medium M is disposed, on the upstream side in the transport direction F with respect to the elastic member 62, and among sections of the removal member 61, the contact surface 65, which comes into contact with the medium M, of the removal member 61 is formed.

For example, as shown in FIG. 4, there is a large amount of slack of the removal member 61 on the downstream side in the transport direction F with respect to the elastic member 62 and there is a small amount of slack of the removal member 61 on the upstream side in the transport direction F with respect to the elastic member 62. When this occurs, as a result of the tare weight thereof, the removal member 61 is displaced in the direction in which the medium M is disposed, on the downstream side in the transport direction F with respect to the elastic member 62, and the contact surface 65, which comes into contact with the medium M, of the removal member 61 is formed.

Asymmetries in the amounts of slack of the removal member 61 on the upstream side in the transport direction F with respect to the elastic member 62 and the downstream side in the transport direction F with respect to the elastic member 62 change the conditions of the removal member 61 and the elastic member 62 (the shape, the material, and the like), the deterioration states, usage conditions (temperature, humidity, and the like), and the like, of the removal member 61 and the elastic member 62.

When the amount of slack of the removal member 61 becomes asymmetric between the upstream side in the transport direction F with respect to the elastic member 62 and the downstream side in the transport direction F with respect to the elastic member 62, it is possible to make the contact surface 65, which comes into contact with the printing surface M1 of the medium M, of the removal member 61 broader than in a case in which the amount of slack of the removal member 61 is symmetric.

In the removal member 61, the section pressed by the elastic member 62 (the substantially fixed section) is disposed on a side of one end of the contact surface 65. The contact surface 65 is formed between the section substantially fixed by the elastic member 62 and the end portion 61*a* fixed to the fixing portion 7. In other words, the contact surface 65 is formed in the removal member 61 between two fixed sections.

Since the contact surface 65 is formed in the removal member 61 between two fixed sections, it is more unlikely that the surface area of the contact surface 65 will fluctuate than in a case in which the contact surface 65 is formed in a removal member 61 in which one end is not fixed.

In this manner, in addition to the fact that, among sections of the removal member 61, the section pressed as a result of the elastic member 62 being provided is formed, the contact surface 65 of the removal member 61 is broadened as a result of the amount of slack of the removal member 61 being set to be asymmetric, and therefore, fluctuations in the surface area of the contact surface 65 of the removal member 61 are made even smaller.

Further, foreign matter adhered to the printing surface M1 of the medium M is removed at both the pressed section of the removal member 61 and the contact surface 65 of the removal member 61.

Since a force that removes foreign matter by using a pressing force is stronger in the pressed section of the removal member 61 than in sections that are not pressed among sections of the removal member 61, the foreign matter removal performance of the removal member 61 is higher.

In addition, as a result of using a broadened contact surface 65, since a force that removes foreign matter acts over a longer period of time than in a case in which the contact surface 65 is narrow, the foreign matter removal performance of the removal member 61 is increased.

In addition, as a result of the fluctuations in the surface area of the contact surface 65 of the removal member 61 being made smaller, it is possible for the removal member 61 to remove foreign matter stably.

Accordingly, as a result of the elastic member 62 being provided, the foreign matter removal performance of the removal member 61 is enhanced, and it is possible to obtain an excellent effect of being able to remove foreign matter stably.

Additionally, in order to obtain an excellent effect by using the elastic member 62, it is important to control the length in the Z direction of the elastic member 62. For example, if the length in the Z direction of the elastic member 62 becomes too long and the surface area of the section in which the elastic member 62 presses the removal member 61 is broadened, a force with which the removal member 61 is biased toward the medium M from the elastic member 62 becomes too strong, and a defect in which transport of the medium M is blocked occurs.

To explain in more detail, if the length in the transport direction F of a section in which the elastic member 62 and the removal member 61 come into contact with one another is longer than roughly 10 mm, a transport fault of the medium M occurs. Accordingly, the length in the transport direction F of the section in which the elastic member 62 and the removal member 61 come into contact with one another is preferably 10 mm or less, and more preferably 5 mm or less.

Embodiment 2

Figure 5:
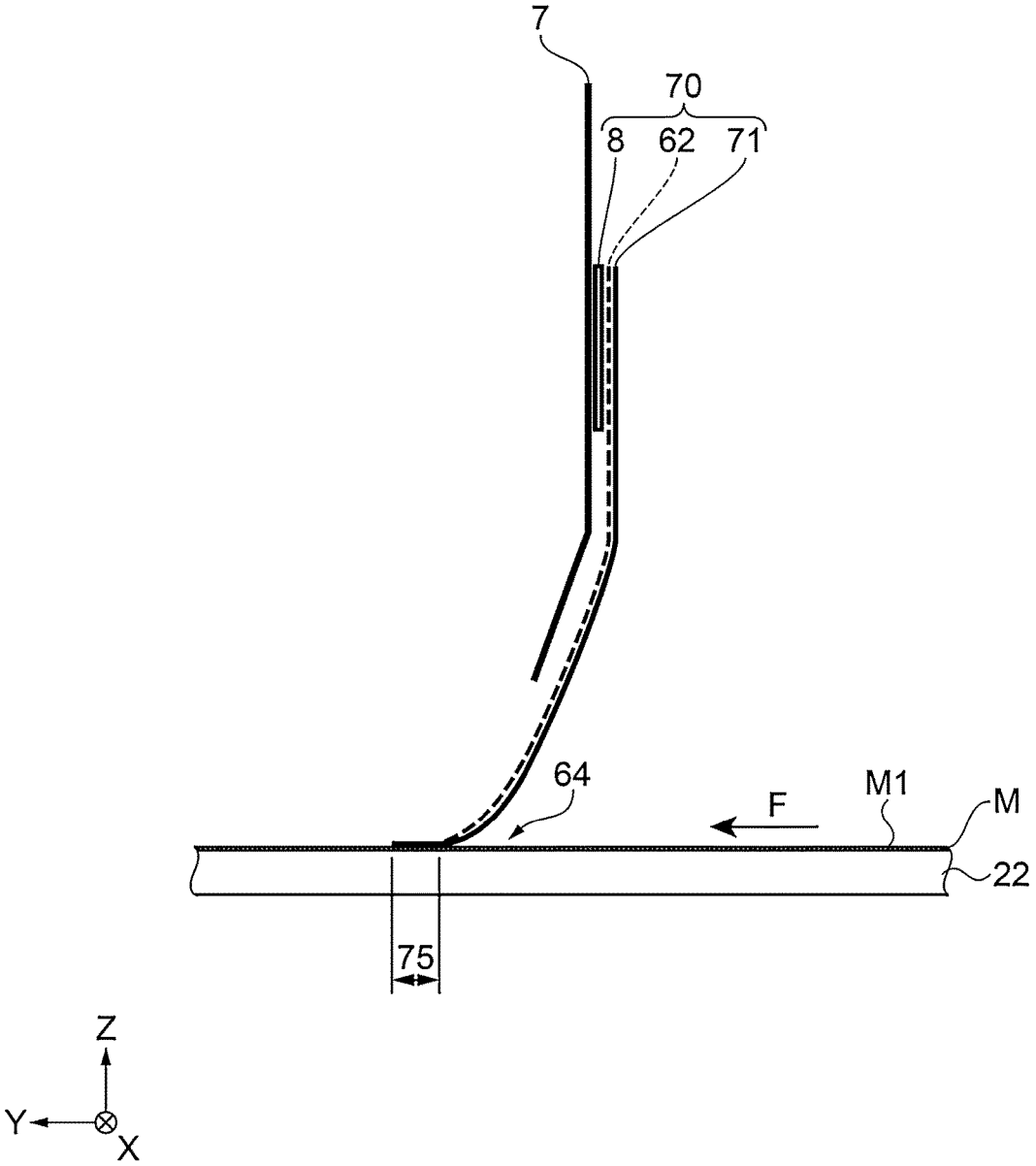
FIG. 5 is a schematic view that shows a state of a removal portion according to Embodiment 2.

FIG. 5 is a view that corresponds to FIG. 3, and is a schematic view that shows a state of a removal portion according to Embodiment 2.

The removal portion 60 according to Embodiment 1 includes the loop-shaped removal member 61 in which both ends are substantially closed. A removal portion 70 according to the present embodiment includes a plate-shaped removal member 71 in which both ends are spatially separated from one another and hang down in the gravity direction. This feature is the main difference between the present embodiment and Embodiment 1.

Hereinafter, a printer according to the present embodiment will be described with reference to FIG. 5 focusing on features that differ from the printing apparatus 10 according to Embodiment 1. In addition, constituent sites that are the same as those of Embodiment 1 will be given the same reference numerals, and overlapping descriptions thereof will be omitted.

As shown in FIG. 5, in the printing apparatus according to the present embodiment, since the removal member 71 hangs down in the gravity direction, the removal portion 70 has a configuration in which a magnet 8, an elastic member 62, and the removal member 71 are disposed in a section that is fixed to the fixing portion 7 in order in the Y (−) direction. On the other hand, in the printing apparatus 10 according to Embodiment 1, since the removal member 61 has the loop shape, the removal portion 60 has a configuration in which the magnet 8, the removal member 61 (the end portion 61*a* side), the elastic member 62, and the removal member 61 (the end portion 61*b* side) are disposed in the section that is fixed to the fixing portion 7 in order in the Y (−) direction (refer to FIG. 3).

The removal member 71 is configured by the same material (an aggregate of fibers) as the removal member 61 according to Embodiment 1.

In a case in which the removal portion 70 is broadened in the Z direction, the length in the Z direction of the removal member 71 of the removal portion 70 is greater than the length in the Z direction of the elastic member 62. In addition, the length in the Z direction in a case in which the removal member 71 of the removal portion 70 is broadened in the Z direction is shorter than the length in the Z direction in a case in which the removal member 61 of the removal portion 60 of Embodiment 1 is broadened in the Z direction.

In a case in which the medium M is transported, among portions of the removal member 71, a facing portion with the medium M is disposed so as to protrude on the Z (−) direction side more than a facing portion with the medium M among portions of the elastic member 62. In this instance, the term "facing portion with the medium M" refers to sections of the respective members that face the medium M. In other words, the term "facing portion with the medium M" refers to sections of the respective members that either come into contact with or are in proximity to the medium M. As a result of using such a configuration, it is likely that the removal member 71 will come into contact with the printing surface M1 of the medium M, and it is unlikely that the elastic member 62 will come into contact with the printing surface M1 of the medium M. At this time, the removal member 71 is disposed between printing surface M1 of the medium M and the elastic member 62, and a contact surface 75, which comes into contact with the printing surface M1 of the medium M, of the removal member 71, is pressed by the elastic member 62.

In a case in which the medium M is transported, the removal member 71 and the elastic member 62 are displaced in the transport direction F. Since the elastic member 62 is disposed on the downstream side in the transport direction F with respect to the removal member 71, displacement in the transport direction F of the removal member 71 is regulated by the elastic member 62, and the removal member 71 is displaced so as to trace the shape of the elastic member 62.

In the present embodiment, in addition to a role of pressing the contact surface 75 of the removal member 71, the elastic member 62 has a role of regulating displacement of the removal member 71 and suppressing shape abnormalities (shape loss) of the removal member 71. That is, when the elastic member 62 is provided, since the removal member 71 is displaced so as to trace the shape of the elastic member 62, shape loss of the removal member 71 is suppressed, and the removal member 71 stably comes into contact with the printing surface M1 of the medium M.

Since the contact surface 75 of the removal member 71 is pressed by the elastic member 62, a force that removes foreign matter adhered to the printing surface M1 of the medium M is stronger than in a case of not being pressed by the elastic member 62, and therefore, it is possible to enhance the removal performance of foreign matter. Furthermore, since shape loss of the removal member 71 is suppressed and the removal member 71 stably comes into contact with the printing surface M1 of the medium M, it is possible for the removal member 71 to stably remove foreign matter adhered to the printing surface M1 of the medium M.

Embodiment 3

Figure 6:
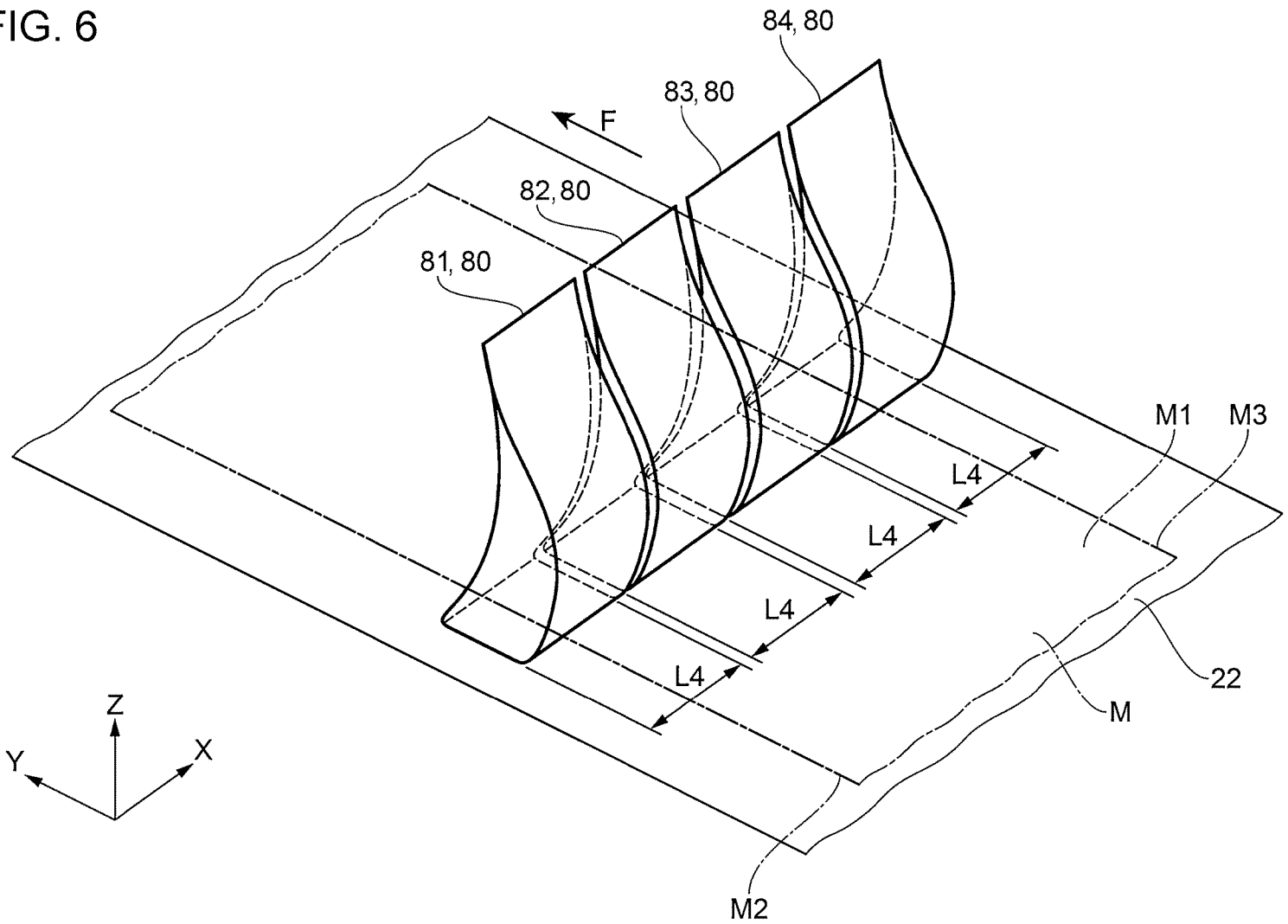
FIG. 6 is a schematic view that shows a state of a removal portion according to Embodiment 3.

FIG. 6 is a view that corresponds to FIG. 2, and is a schematic view that shows a state of a removal portion according to Embodiment 3.

A removal portion 80 according to the present embodiment is divided into a plurality, the removal portion 60 according to Embodiment 1 is not divided into a plurality, and this feature is the main difference between the present embodiment and Embodiment 1.

Hereinafter, a printer according to the present embodiment will be described with reference to FIG. 6 focusing on features that differ from the printing apparatus 10 according to Embodiment 1. In addition, constituent sites that are the same as those of Embodiment 1 will be given the same reference numerals, and overlapping descriptions thereof will be omitted.

As shown in FIG. 6, in the printing apparatus according to the present embodiment, the removal portion 80 is configured by a first removal portion 81, a second removal portion 82, a third removal portion 83, and a fourth removal portion 84. That is, the removal portion 80 is configured by removal portions 81, 82, 83, and 84 that are divided into four. The first removal portion 81, the second removal portion 82, the third removal portion 83, and the fourth removal portion 84 are arranged in order in a direction that intersects the transport direction F. In this manner, the removal portion 80 is divided into a plurality in the direction that intersects the transport direction F.

Furthermore, the length in the width direction length of the first removal portion 81, the length in the width direction length of the second removal portion 82, the length in the width direction length of the third removal portion 83, and the length in the width direction length of the fourth removal portion 84 are all L4, and are all the same.

When the removal portion 80 is divided into the plurality of removal portions 81, 82, 83, and 84, in a case in which a defect such as a scuff occurs in the removal portion 80, it is not necessary to replace the entire removal portion 80, and it is sufficient to replace the removal portion 80 of a section in which the defect occurred only. For example, in a case in which a defect occurs in the first removal portion 81, since it is sufficient to replace the first removal portion 81 only, it is possible to suppress costs of replacement members in comparison with a case in which all of the removal portions 81, 82, 83, and 84 are replaced.

In this manner, a configuration in which the replacement of a portion of the removal portions that are divided into a plurality is possible (the configuration of the present embodiment) can suppress retention costs of the printing apparatus 10 in comparison with a configuration in which the entire removal portion is replaced (the configuration of Embodiment 1).

The four removal portions 81, 82, 83, and 84 are respectively the same length, are standardized, and it is possible to respectively replace the four removal portions 81, 82, 83, and 84 with the same member. In this manner, since a general-purpose property of the member for replacement is enhanced, it is possible to achieve a cost-reduction of the member for replacement.

However, the lengths in the width direction of the four removal portions 81, 82, 83, and 84 need not necessarily be set to be the same. A configuration in which the lengths in the width direction of the four removal portions 81, 82, 83, and 84 are differentiated or in which a portion thereof is aligned may be used.

Furthermore, in a case in which the foreign matter removal performance of the removal portion 80 is decreased, it is sufficient to implement maintenance that restores the foreign matter removal performance by detaching the removal portion 80 in which the foreign matter removal performance is decreased only without it being necessary to implement maintenance by detaching the entire removal portion 80. For example, in a case in which the foreign matter removal performance of the first removal portion 81 is decreased, it is sufficient to implement maintenance that restores the foreign matter removal performance of the first removal portion 81 only by detaching the first removal portion 81 only, and therefore, maintenance is easier than in a case in which maintenance is implemented for all of the removal portions 81, 82, 83, and 84.

Furthermore, since the removal portion 80 is divided into the plurality of removal portions 81, 82, 83, and 84 and the size of the removal portions 81, 82, 83, and 84 is small, replacement work and maintenance work of the removal portions 81, 82, 83, and 84 is easy, and therefore, the efficiency of the work is improved and it is also possible to suppress defects such as work errors.

In a case in which the removal portion is divided into a plurality, the number of divisions of the removal portion is not limited to the above-mentioned four, and may be more than four, or may be less than four.

Furthermore, when the removal portion is divided into a plurality, there are spaces between a divided removal portion (for example, the first removal portion 81), and a removal portion (for example, the second removal portion 82) adjacent to the divided removal portion. In the above-mentioned manner, it is likely that a large amount of foreign matter will become adhered to the end portions (the ends M2 and M3 of the printing surface M1 of the medium M) of the medium M. Therefore, it is preferable that the removal portion be disposed so as to come into contact with the ends M2 and M3 of the printing surface M1 of the medium M.

Accordingly, in a case in which the removal portion is divided into a plurality, it is preferable that the removal portion be divided into a plurality so that the spaces of the divided removal portions are not disposed at the ends M2 and M3 of the printing surface M1 of the medium M.

Embodiment 4

A removal portion 60 according to Embodiment 4 is an aggregate of fibers that has a conductive property, and has a conductive property.

For example, as the fiber having a conductive property that configures the removal portion 60, it is possible to use a fiber composed of a polymer with a main chain having a structure in which double bonds and single bonds are alternately aligned, or a fiber composed of a conductive polymer such as a polypyrrole polymer, a polythiophene polymer, a polyaniline polymer, or a polyacetylene polymer.

In a case in which static electricity is accumulated on the printing surface M1 of the medium M and foreign matter becomes strongly adhered to the printing surface M1 of the medium M, it is likely that foreign matter adhered to the printing surface M1 of the medium M will be removed when the static electricity accumulated on the printing surface M1 of the medium M neutralized by the removal portion 60. Accordingly, as a result of the removal portion 60 having a conductive property, it is likely that foreign matter adhered to the printing surface M1 of the medium M will be removed.

Additionally, the removal portion 60 may be an aggregate of a fiber that has a conductive property and a fiber that does not have a conductive property.

This application claims priority under 35 U.S.C. § 119 to Japanese Patent Application No. 2016-090392, filed Apr. 28, 2016. The entire disclosure of Japanese Patent Application No. 2016-090392 is hereby incorporated herein by reference.

What is claimed is:

1. A printing apparatus comprising:

a printing portion that performs printing on a printing surface of a medium;

a transport portion that transports the medium in a transport direction;

a medium support portion that is disposed on an upstream side in the transport direction with respect to the printing portion and supports the medium;

a removal portion that is disposed on the upstream side in the transport direction with respect to the printing portion; and a fixing portion to which the removal portion is fixed, wherein the removal portion includes a removal member that has a flexible property and comes into contact with the printing surface, and an elastic member that holds the removal member between itself and the medium support portion, and that presses the removal member, wherein a length of the elastic member in a width direction, which is orthogonal to the transport direction, is shorter than a length of the removal member in the width direction, and wherein, among portions of the elastic member, an end portion in the width direction is disposed on an inner side of an end portion in the width direction among portions of the removal member.

2. The printing apparatus according to claim 1, wherein the removal member is slack between a section fixed to the fixing portion, and a section pressed by the elastic member.

3. The printing apparatus according to claim 1, wherein the removal portion is disposed so as to, among portions of the medium, come into contact with an end portion in the width direction, which is orthogonal to the transport direction.

4. The printing apparatus according to claim 1, wherein the removal portion is divided into a plurality along a direction that intersects the transport direction.

5. The printing apparatus according to claim 1, wherein the removal member is an aggregate of fibers.

6. The printing apparatus according to claim 1, wherein the removal portion is attached to the fixing portion in a detachable manner.

7. A printing apparatus comprising:

a printing portion that performs printing on a printing surface of a medium;

a transport portion that transports the medium in a transport direction;

a medium support portion that is disposed on an upstream side in the transport direction with respect to the printing portion and supports the medium;

a removal portion that is disposed on the upstream side in the transport direction with respect to the printing portion; and a fixing portion to which the removal portion is fixed, wherein the removal portion includes a removal member that has a flexible property and comes into contact with the printing surface, and an elastic member that holds the removal member between itself and the medium support portion, and that presses the removal member, wherein the removal member and the elastic member are disposed so that, among portions of the removal member, a facing portion with the medium protrudes more than a facing portion with the medium among portions of the elastic member.

8. A printing apparatus comprising:

a printing portion that performs printing on a printing surface of a medium;

a transport portion that transports the medium in a transport direction;

a medium support portion that is disposed on an upstream side in the transport direction with respect to the printing portion and supports the medium;

a removal portion that is disposed on the upstream side in the transport direction with respect to the printing portion; and a fixing portion to which the removal portion is fixed, wherein the removal portion includes a removal member that has a flexible property and comes into contact with the printing surface, and an elastic member that holds the removal member between itself and the medium support portion, and that presses the removal member, wherein, in the removal member, one end portion and another end portion are fixed to the fixing portion, and a section which is curved between the one end portion and the other end portion comes into contact with the printing surface.

* * * * *